United States Patent [19]

Mitsuyu et al.

[11] 4,276,535

[45] Jun. 30, 1981

[54] THERMISTOR

[75] Inventors: Tsuneo Mitsuyu, Hirakata; Kiyotaka Wasa, Nara; Shigeru Hayakawa, Hirakata, all of Japan

[73] Assignee: Matsushita Electric Industrial Co., Ltd., Japan

[21] Appl. No.: 125,231

[22] Filed: Feb. 27, 1980

Related U.S. Application Data

[63] Continuation-in-part of Ser. No. 933,742, Aug. 15, 1978, abandoned.

[51] Int. Cl.[3] ..... H01C 7/04

[52] U.S. Cl. ..... 338/22 R; 204/192 F; 338/309

[58] Field of Search ..... 338/22 R, 225 D, 308, 338/309; 29/612; 204/192 F, 192 S, 192 SP; 427/101-103

[56] References Cited

U.S. PATENT DOCUMENTS

| | | | |
|---|---|---|---|
| 2,405,192 | 8/1946 | Davis | 338/22 R X |
| 2,880,295 | 3/1959 | Huffman | 338/22 R X |
| 2,916,460 | 12/1959 | Van Der Beck, Jr. | 338/22 R |
| 3,019,198 | 1/1962 | Dumesnil | 338/22 R |
| 3,219,480 | 11/1965 | Girard | 338/22 R X |
| 3,267,403 | 8/1966 | Guarnieri | 338/22 R |
| 3,339,164 | 8/1967 | Landis et al. | 338/22 R |
| 3,364,066 | 1/1968 | Karlson et al. | 338/22 R |
| 3,452,314 | 6/1969 | Sapoffe et al. | 204/192 F X |
| 3,469,224 | 9/1969 | Riddel et al. | 338/22 R |
| 3,622,901 | 11/1971 | Ledran et al. | 204/192 F X |
| 3,801,949 | 4/1974 | Larraheu | 338/22 R |
| 3,851,291 | 11/1974 | Sommer | 204/192 F X |
| 4,086,559 | 4/1978 | Knippenberg et al. | 338/308 X |
| 4,129,848 | 12/1978 | Frank et al. | 204/192 F X |
| 4,140,989 | 2/1979 | Brixeras et al. | 338/309 X |

*Primary Examiner*—C. L. Albritton

*Attorney, Agent, or Firm*—Wenderoth, Lind & Ponack

[57] ABSTRACT

A high performance, precision thermistor comprising a temperature sensitive resistor in the form of a thin, uniform layer of silicon carbide, deposited on a base support by sputtering, and electrode means attached to the temperature sensitive resistor in electrically connected relation to the temperature sensitive resistor.

14 Claims, 6 Drawing Figures

THERMISTOR

This is a continuation-in-part of Ser. No. 933,742, filed Aug. 15, 1978, now abandoned.

BACKGROUND OF THE INVENTION

The present invention relates to a thermistor and, more particularly, to a thermistor utilizing a thin, uniform temperature sensitive layer of silicon carbide deposited on a suitable substrate by sputtering.

Conventional thermistors are now available in the form of beads, rods, discs or flakes, however, because of their particular construction, all exhibit an insufficient responsive to change in ambient temperature.

Conventional thermistors, operable at elevated temperatures, typically employ a temperature sensitive layer comprising as a principal component, either alumina or silicon carbide. The deficiencies of such thermistors are as follows.

The conventional high temperature sensing thermistors utilizing alumina are problematic with regard to stability. The conventional silicon carbide high temperature sensing thermistor utilizing silicon carbide as either a single crystal or a polycrystalline body thereof, are superior to devices using alumina in terms of stability but normally need a long time for the response and are difficult and expensive to manufacture. Such devices are disclosed, for example, in Landis et al., U.S. Pat. No. 3,339,164 or Van der Beck, U.S. Pat. No. 2,916,460.

SUMMARY OF THE INVENTION

Accordingly, it is an object of the present invention to substantially eliminate the above described disadvantages inherent in the foregoing conventional thermistors and it is a further object to provide an improved, high precision thermistor stable in performance, which thermistor utilizes a layer of silicon carbide.

Another important object of the present invention is to provide an improved, high precision thermistor of the type referred to above, which is inexpensive.

These objects of the present invention can readily be achieved by providing a thermistor which comprises a temperature sensitive resistor in the form of a thin, uniform layer of silicon carbide, deposited on a base support by sputtering, and electrode means attached to the temperature sensitive resistor in electrically connected relation to the temperature sensitive resistor.

In one preferred embodiment of the present invention the electrode means is constituted by a pair of spaced electrodes. On the other hand, in another preferred embodiment, the electrode means is constituted by a single electrode while the base support is made of an electrically conductive material and, therefore, it serves not only as a support for the temperature sensitive resistor, but also as another electrode.

Where the electrode means is constituted by the pair of spaced electrodes and the base support is made of the electrically conductive material, the use of a layer of electrically insulating material is preferred. This insulating layer may be positioned between the temperature resistor and the base support. Alternatively, the electrodes may be mounted on the base support with the insulating layer positioned between the base support and the electrodes.

BRIEF DESCRIPTION OF THE DRAWINGS

These and other objects and features of the present invention will become apparent from the following description taken in conjunction with preferred embodiments thereof with reference to the accompanying drawings, in which.

DETAILED DESCRIPTION OF THE INVENTION

Figure 1:
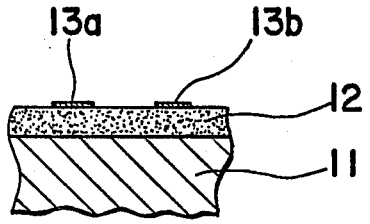
FIGS. 1 to 4 are schematic side sectional views of a thermistor according to different preferred embodiments of the present invention, respectively.

Before the description of the present invention proceeds, it is to be noted that like parts are designated by like reference numerals throughout the accompanying drawings.

Referring first to FIG. 1, a thermistor according to a first preferred embodiment of the present invention comprises a base support 11 having one surface on which a temperature sensitive resistor 12 is deposited by sputtering in the form of a layer of silicon carbide. The thermistor further comprises a pair of electrodes **13*a* and 13*b* deposited in spaced relation to each other on one of the opposed surfaces of the resistor or silicon carbide layer 12 which is remote from the base support 11**.

Figure 2:
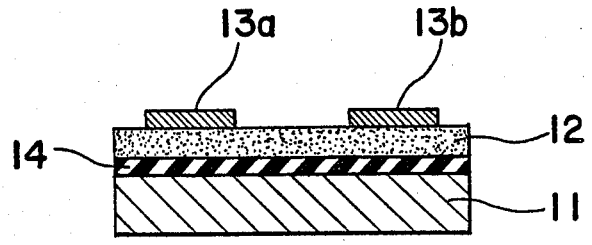

In the embodiment shown in FIG. 1, the base support 11 must be made of an electrically insulating material, such as glass, an alumina plate or a ceramic material. We have found that the use of silicon carbide deposited by sputtering for the resistor 12 results in a thermistor capable of exhibiting high precision and stable performance not available with the conventional thermistors employing silicon carbide in the form of a single crystal.

Where the base support 11 is made of an electrically conductive material, such as a metal or a semiconductor, of a type having a relatively high thermal conductivity, a layer of electrically insulating material, such as glass, silicon oxide or alumina, should be positioned, as shown by 14 in FIG. 2, between the resistor or silicon carbide layer 12 and the base support 11.

We have found that, with the thermistor of the construction shown in FIG. 2, the responsivity has been improved. This is because the metal or semiconductor, which is employed as a material for the base support 11 in the embodiment shown in FIG. 2, has a higher thermal conductivity than that of a glass or ceramic material employed in the foregoing embodiment of FIG. 1 and, therefore, when the thermistor of the construction shown in FIG. 2 is applied to a structural element of which temperature is to be sensed, the temperature of such structural element can readily be transmitted to the resistor or silicon carbide layer 12 through the base support 11.

Of various kinds of electrically conductive materials of high thermal conductivity to be used for the base support 11 in the example of FIG. 2, the use of silicon is preferred. This is because, if silicon is employed as a material for the base support 11, the latter can readily be manufactured in the form of a plate having a smooth surface which is required for the resistor or silicon carbide layer 12 to be uniformly deposited thereon. If the silicon carbide layer 12 can be deposited on the base support 11 so as to have a uniform thickness, each of the electrodes 13*a* and 13*b* can also be deposited precisely and, therefore, the resultant thermistor can have a precise resistance characteristic. Moreover, silicon has a relatively high resistance to the elevated temperature and, therefore, is suited as a material for the base support 11 for a thermistor operable at the elevated temperature.

It is to be noted that, in the embodiment shown in FIG. 2, a similar effect can be obtained even if the base support 11 is made of an electrically insulating material having a high thermal conductivity. Therefore, it is possible to prepare the base support 11 from any one of diamond and beryllium oxide. However, this is not practical because the diamond is expensive and the beryllium oxide is harmful to the human body.

Referring still to FIG. 2, the electrically insulating layer 14 is employed for electrically insulating the resistor or silicon carbide layer 12 from the base support 11 and has a thickness within the range of 1 to 5 μm. As a material for the electrically insulating layer 14, any material having a relatively high electric insulating property, a relatively high resistance to the elevated temperature and a relatively high bondability to any one of the base support 11 and the silicon carbide layer 12 may be employed. We have found that the insulating material which satisfies the above described requirements includes an oxidized or nitrided product of the material for the base support 11. For example, where the base support 11 is made of silicon, the insulating layer 14 may be made of either silicon oxide or silicon nitride. This insulating layer 14 can directly be formed on the surface of base support 11 prior to deposition of the resistor or silicon carbide layer 12 in any known manner, for example, by the utilization of anodic oxidization, thermal oxidization, vapor deposition or sputtering deposition.

The silicon carbide forming the resistor 12 has a melting point of 2,700° C. and is, therefore, considered to be highly heat resistant and stable in properties not only at elevated temperatures, but also in the atmosphere. Moreover, the silicon carbide is also considered to have a relatively high resistance-temperature coefficient characteristic over a relatively wide range of temperature and is, therefore, suitable for use as a material for the thermistor operable at elevated temperatures. In the present invention, this silicon carbide is employed in the form of a thin layer and, therefore, the resultant thermistor has a response time of not more than 10 milliseconds and also a precise performance. With respect to the response time, this advantage can be obtained because the thermal capacitance of the resistor 12 is extremely low since the resistor 12 is employed in the form of a thin layer, and also because thermal connection with the structural element of which temperature is to be sensed can be achieved tightly. With respect to the precise performance, this advantage can be obtained because the resistance can be determined by the thickness of the resistor 12 and the shape of each of the electrodes 13*a* and 13*b*, which can readily be adjusted, because resistor 12 can readily be formed densely and uniformly by sputtering, in contrast to sintering.

It has been discovered that according to the present invention, an rf (radio frequency)—sputtering deposition from silicon carbide target is preferable for a production of said temperature sensitive resistance layer of silicon carbide with high reproducibility.

It has also been discovered that according to the present invention, there exists optimum sputtering conditions for said rf-sputtering deposition. In the optimum sputtering conditions according to the present invention, a temperature of said base support is ranged from 200° to 800° C., a deposition rate of said temperature sensitive resistance layer is ranged from 0.1 to 10 μm/hr, and a sputtering gas pressure is ranged from $1\times10^{-3}$ to $1\times10^{-1}$ Torr of argon. Said silicon carbide target is preferably composed of silicon carbide powder or pure sintered silicon carbide disk. Said sintered silicon carbide disk target is more preferable for a production of said temperature sensitive resistance layer since a stable sputtering deposition is realized in a long sputtering run by using said sintered silicon carbide disk target. At the temperature of said base support below 200° C. during the sputtering deposition, said temperature sensitive resistance layer is found to have poor aging properties. At the temperature above 800° C., said temperature sensitive layer is found to have poor adhesion to said base support. At the deposition rate of said temperature sensitive layer below 0.1 μm/hr, said temperature sensitive layer is found to be contaminated by residual gases in a sputtering system, at said deposition rate, above 10 μm/hr said temperature sensitive lyaer often shows poor adhesion to said base support. Pure argon gas is found to be preferable for a sputtering gas for a production of said temperature sensitive layer with high reproducibility in a thermistor property. The argon gas pressure for said sputtering deposition ranged from $1\times10^{-3}$ to $1\times10^{-1}$ Torr realizes a stable sputtering deposition for a long sputtering run. It has further discovered that according to the present invention, the temperature of said base support during said sputtering deposition ranged from 600° to 700° C. is much more preferable in order to realize high stable operation of said thermistor at high temperature. At the temperature below 600° C., a positive increase of resistance is observed in an aging property of the thermistor according to the present invention. At the temperature above 700° C., a negative increase of resistance is observed in said aging property. At the temperature between 600° to 700° C., the resistance change of the present thermistor is very small; for instance, said resistance change is less than 1% after exposure to air for 2000 hours at 400° C.

The thickness of said temperature sensitive resistance layer 12 is preferably within the range of 1 to 10 μm in order to realize a stable performance of the thermistor according to the present invention.

The present inventors have also discovered that resistor 12 of silicon carbide can be deposited by a variety of methods other than sputtering, for example, by the utilization of gasphase growth, electron beam deposition, or ion beam deposition methods, however, the sputtering deposition method provides considerable advantages over these other than methods in terms of uniformity of the thin layer thickness, chemical composition, and crystal structure. In addition, the sputering deposition process according to the present invention realizes a production of the silicon carbide layer for the thermistor at lower temperature during the deposition than said other means including gas phase growth, electron beam deposition, and ion beam deposition methods.

While the present silicon carbide layer deposited by sputtering contains numerous crystal lattice defects, these defects are distributed quite uniformly throughout the silicon carbide layer, particularly when compared with the silicon carbide layer having single crystal or polycrystalline structure. Due to the specific character of the crystal structure of the silicon carbide layer deposited by sputtering deposition, the resultant thermistor has particularly high electrical conductivity with a relatively high resistance-temperature coefficient over a relatively wide temperature range.

Moreover, in the sputtering deposition method, rather minute particles of SiC, each having a particle size on the order of a single molecule, are deposited to form the thin layer, whereby the resultant configuration of the sputtered particles is quite homogenous. Accordingly, the layer per se is readily reproducible, with its characteristic properties substantially unchanged.

The electrodes 13*a* and 13*b* may be made of any known electroconductive material, preferably, a multilayer of platimun and chromium. Where the heat resistance of the material for the electrodes 13*a* and 13*b* is of no importance, a layer of aluminum, gold-chromium and copper-chromium may be employed for the electrodes 13*a* and 13*b*. Deposition of these electrodes 13*a* and 13*b* can readily be carried out by the use of any known method, for example, a photo-etching method. Alternatively, if the electrodes 13*a* and 13*b* are formed by baking platinum or platinum-gold by the employment of a known screen printing method, the heat resistance of the electrodes 13*a* and 13*b* can be improved, but the workability will be reduced as compared with the electrodes formed by the photoetching technique.

Figure 3:
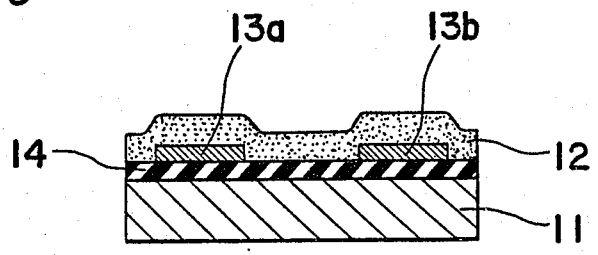

In the embodiment shown in FIG. 3, the electrodes 13*a* and 13*b* are positioned between the resistor or silicon carbide layer 12 and the electrically insulating layer 14. This arrangement is advantageous in that the possibility of physical or chemical damage to one or both of the electrodes 13*a* and 13*b* can be minimized, thereby providing a thermistor which can be used under severe conditions. However, since the electrodes 13*a* and 13*b* tend to be susceptible to damage during the subsequent deposition of the resistor or silicon carbide layer 12 onto the electrically insulating layer 14, each of the electrodes 13*a* and 13*b* must have a sufficiently great thickness, or the known screen printing method should be employed to form these electrodes 13*a* and 13*b*.

In any one of the foregoing embodiments, the number of the electrodes has been described as two. However, as long as the base support 11 is made of an electrically conductive material such as metal or semiconductor, it is possible to employ a single electrode such as shown by 13 in FIG. 4. In other words, in the embodiment shown in FIG. 4, the base support 11 concurrently serves as a counter electrode. It is to be noted that, in order for the base support 11 to serve as the counter electrode cooperative with the electrode 13, the electrically insulating layer 14 which has been described as employed in any one of the foregoing embodiments of FIGS. 2 and 3 should not be employed.

With the foregoing arrangement, current can flow in a direction across the thickness of the resistor or silicon carbide layer 12 and, therefore, depending upon the thickness of the silicon carbide layer 12, the resistance between the electrode 13 and the counter electrode, that is, the base support 11, can be minimized. Accordingly, as compared with any one of the embodiments shown in FIGS. 2 and 3, the thermistor according to the embodiment shown in FIG. 4 can be manufactured in a compact size for a given resistance characteristic required, with no substantial reduction in responsivity. We have found that the thermistor according to the embodiment shown in 4 is advantageous in that it can be manufactured in a compact size accordingly.

Figure 4:
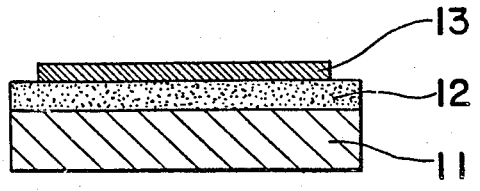

However, in the manufacture of the thermistor according to the embodiment shown in FIG. 4, care must be taken to avoid any possible formation of pin holes in the resistor or silicon carbide layer 12 which may constitute a cause of electric short circuiting between the electrode 13 and the counter electrode, that is, the base support 11. In addition, where the base support 11 is made of a semiconductor material, addition of suitable impurities to the semiconductor material is preferred to render the resultant base support 11 of relatively low specific resistance.

Figure 5:
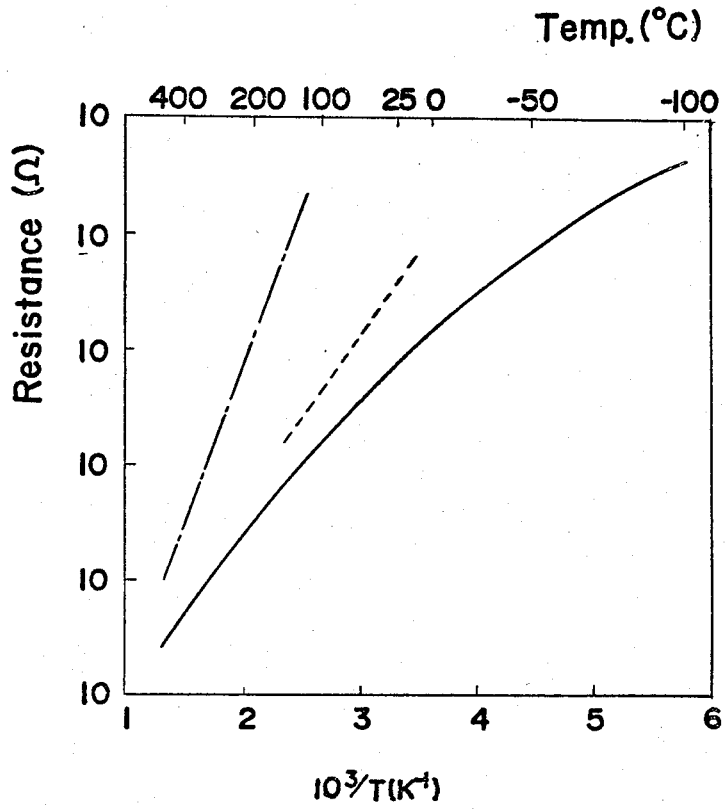
FIG. 5 is a graph illustrating the performance characteristic of the thermistor of the construction shown in FIG. 1, together with those of the conventional thermistors for the purpose of comparison.

The thermistor of the construction shown in FIG. 1 has been tested as to its resistance-temperature characteristic, the result of which is shown in a graph of FIG. 5. As shown by the solid line in the graph of FIG. 5, the thermistor of the construction shown in FIG. 1 is operable within the range of −100° C. to 450° C. and exhibits a thermistor constant of 1,600° to 3,500° K. For the purpose of comparison, similar resistance-temperature characteristics of the conventional thermistors are respectively shown by the broken line and the chain line in the graph of FIG. 5. FIG. 5 shows a fact such that thermistors of Mn-Co-Ni-O system cannot use at the high temperature while thermistors of $Al_2O_3$ system are merely used within the high temperature.

Furthermore, it has also been found that, in the thermistor according to the present invention, neither oxidization nor change in performance characteristics under a reducing atmosphere take place. By way of example, even though the thermistor according to the present invention has been used in contact with oil and in an environment full of combustion gases, no change in performance characteristics of the thermistor takes place. Moreover, the thermistor according to the present invention is quick to respond to change in temperature, for example, not more than 10 milliseconds in comparison with the conventional one of Landis et al., U.S. Pat. No. 3,339,164 necessary to response for long time of few seconds.

Yet, the thermistor according to the present invention can readily be manufactured. More specifically, while according to the prior art, 10% of thermistors had a variation in resistance characteristics, the present invention is such that not more than 3% of thermistors vary in resistance characteristics and not more than 0.5% of thermistors vary in thermistor constant.

Further, the present thermistors are far more responsive to changes in resistance with respect to temperature than the conventional ones such as that of Landis et al., U.S. Pat. No. 3,339,164 which is typical of the closest against the present invention. Thus, in the Table in column 6 of Landis, the percentage change of resistance per °C. change of temperature of SiC is 0.2%/°C., while that of the present invention is approximately 1%/°C. In other words, the percentage change of resistance per °C. change of temperature of the SiC according to the present invention is about five times greater than that of the SiC thermistor of Landis.

Figure 6:
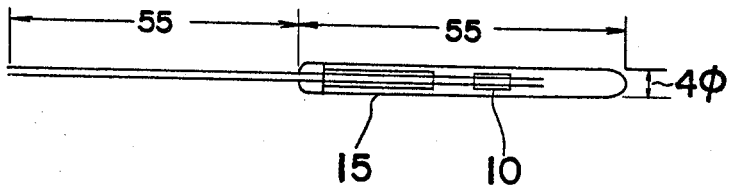
FIG. 6 is a schematic side view of a thermistor housed in a glass tube according to a further preferred embodiment of the present invention.

It is also to be noted that, as shown in FIG. 6, the thermistor of the construction shown in any one of FIGS. 1 to 4 may be enclosed in a casing 15 made of any suitable material. Preferably, where the quick response time is a factor to be taken into consideration, the casing 15 should be in the form of a metallic casing, whereas when the resistance to chemical corrosion is a factor to be taken into consideration, the casing 15 should be in the form of a glass casing. In FIG. 6, the thermistor is generally indicated by 10 and has a pair of lead wires respectively connected to the electrodes 13*a* and 13*b* or 13 and 11 and extending outwards from the glass casing 15.

Although the present invention has fully been described by way of examples, it is to be noted that various changes and modifications are apparent to those skilled in the art. Such changes and modifications are, unless they depart from the true scope of the present invention, to be understood as included therein.

We claim:

1. A thermistor comprising a base support, a temperature sensitive resistance layer of silicon carbide applied by sputtering deposition on one surface of said base support, and electrode means electrically connected to said temperature sensitive resistance layer of silicon carbide.

2. A thermistor as claimed in claim 1, wherein said base support is made of electrically insulating material.

3. A thermistor as claimed in claim 1, further comprising a layer of electrically insulating material positioned between the temperature sensitive resistance layer and the base support.

4. A thermistor as claimed in claim 3, wherein said base support is made of electrically conductive material.

5. A thermistor as claimed in claim 4, wherein said electrically conductive material is a metal.

6. A thermistor as claimed in claim 4, wherein said electrically conductive material is a semiconductor.

7. A thermistor as claimed in claim 1, wherein said electrode means is constituted by first and second electrodes.

8. A thermistor as claimed in claim 7, wherein said first and second electrodes are positioned between the base support and the temperature sensitive resistance layer.

9. A thermistor as claimed in claim 7, wherein said first and second electrodes are positioned on an outer surface of the temperature sensitive resistance layer remote from the base support.

10. A thermistor as claimed in claim 1, wherein said electrode means is constituted by one electrode positioned on an outer surface of the temperature sensitive resistance layer remote from the base support, and wherein said base support is made of an electrically conductive material and concurrently serves as a counter electrode cooperative with said electrode on the outer surface of the temperature sensitive resistance layer.

11. A thermistor as claimed in claim 6, wherein said semiconductor is silicon.

12. A thermistor as claimed in claim 3, wherein said base support is made of electrically conductive material and wherein said electrically insulating layer is made of a material selected from the group consisting of silicon oxides and silicon nitrides.

13. A thermistor as claimed in claim 1 wherein said silicon carbide layer has a thickness within the range of from 1–10 $\mu$m.

14. A thermistor as claimed in claim 1, said sputtering deposition is conducted by an rf-sputtering of silicon carbide target wherein a temperature of said base support is kept 600° to 700° C., a deposition rate of said temperature sensitive resistance layer of silicon carbide is ranged from 0.1 to 10 $\mu$m/hr, and a sputtering gas pressure is ranged from $1\times10^{-1}$ to $1\times10^{-1}$ Torr of argon.

* * * * *

UNITED STATES PATENT AND TRADEMARK OFFICE

CERTIFICATE OF CORRECTION

PATENT NO. : 4,276,535

DATED : June 30, 1981

INVENTOR(S) : Tsuneo Mitsuyu, Kiyotaka Wasa and Shigeru Hayakawa

It is certified that error appears in the above-identified patent and that said Letters Patent are hereby corrected as shown below:

On the title page, after Item [22] insert the following:

-- Foreign Application Priority Data

August 23, 1977 [JP] Japan ..... 101320 --.

Signed and Sealed this

*Twenty-third* Day of *March 1982*

[SEAL]

*Attest:*

GERALD J. MOSSINGHOFF

*Attesting Officer* *Commissioner of Patents and Trademarks*